United States Patent [19]

Kikuchi

[11] Patent Number: 4,919,555

[45] Date of Patent: Apr. 24, 1990

[54] CARBON RIBBON SUPPLY APPARATUS FOR A PRINTER

[75] Inventor: Hidenori Kikuchi, Iwate, Japan

[73] Assignee: Kabushiki Kaisha Sato, Japan

[21] Appl. No.: 202,704

[22] Filed: Jun. 3, 1988

[30] Foreign Application Priority Data

Jun. 9, 1987 [JP] Japan ..... 62-88128[U]

[51] Int. Cl.[5] ..... B41J 33/56

[52] U.S. Cl. ..... 400/224.2; 400/234; 400/242; 400/246; 242/68.3; 242/57.1

[58] Field of Search ..... 400/242, 246, 234, 224.2; 242/68.3, 57.1; 101/218, 216, 212

[56] References Cited

U.S. PATENT DOCUMENTS

| | | | |
|---|---|---|---|
| 3,361,490 | 1/1968 | Bassan | 308/15 |
| 3,508,718 | 4/1970 | Paul, Jr. et al. | 242/68.3 |
| 3,759,456 | 9/1973 | Moneagle et al. | 242/57.1 |
| 3,767,132 | 10/1973 | Edwards | 242/68.3 |
| 3,817,173 | 6/1974 | Merbold et al. | 101/218 |
| 4,350,064 | 11/1982 | Garnean | 242/68.3 |
| 4,438,695 | 3/1984 | Maier et al. | 101/375 |
| 4,444,364 | 4/1984 | Dahl et al. | 242/68.3 |
| 4,458,591 | 7/1984 | Guaraldi | 101/218 |
| 4,591,879 | 5/1986 | Yokota et al. | 400/234 |
| 4,610,749 | 9/1986 | Barreto | 242/57.1 |
| 4,697,516 | 10/1987 | Rombont | 101/375 |
| 4,709,871 | 12/1987 | Tanaka et al. | 242/68.3 |

FOREIGN PATENT DOCUMENTS

| | | | |
|---|---|---|---|
| 1611425 | 12/1970 | Fed. Rep. of Germany | 400/246 |

*Primary Examiner*—William Pieprz

*Attorney, Agent, or Firm*—Ostrolenk, Faber, Gerb & Soffen

[57] ABSTRACT

The supply spindle for the carbon ribbon in a thermal printer is supported cantileverly at one end thereof by a pair of axially spaced bearings. The axis of the second bearing is slightly off center relative to the axis of the first bearing, the precise location of the second bearing being adjustable in a manner that tilts and thus orients the spindle axis relative to the frame of the thermal printer. This enables the supply spindle to be aligned to the other parts in the printer so as to prevent twisting and wrinkling of the carbon ribbon. The invention compensates for manufacturing and assembly tolerances in the thermal printer and results in a consistently reliable printing quality.

12 Claims, 4 Drawing Sheets

CARBON RIBBON SUPPLY APPARATUS FOR A PRINTER

BACKGROUND OF THE INVENTION

The present invention relates to a carbon ribbon supply mechanism for printers, and more particularly to a carbon ribbon supply mechanism having an adjustable spindle axis effective for preventing wrinkling of thin and comparatively wide, thermal-type, carbon ribbons.

For background, reference is made to FIG. 5 which shows the main components of a conventional thermal-type printing mechanism. The printing mechanism 1 includes a thermal print head 2 having heatable dot elements for creating desired print patterns, and a platen 3 juxtaposed to the print head 2 and suitable for pressing a thermal label strip 4 and a superposed carbon ribbon 5 against the print head 2. Passage of the superposed thermal label strip 4 and carbon ribbon 5 against the print head 2 at a given speed causes the carbon ribbon 5 to be heated in accordance with the changing dot patterns of the print head so as to transfer the pattern onto labels 7 disposed atop thermal label strip 4.

Thermal label strip 4 is constituted of a backing sheet 6 which is covered with a separating agent such as silicon oil and a plurality of discreet, serially disposed, labels 7, each of which is coated with a pressure-sensitive adhesive for relatively easy detachment from the backing sheet 6. The labels 7 are separable from one another along tear-off perforations 8.

The label strip 4 and the carbon ribbon 5 are individually supplied from respective supply spindles and each is taken up by a respective take-up spindle. It is possible, if desired, to bend the backing sheet 6 sharply at a label peeling plate 9 to cause the labels 7 to separate from the backing sheet 6 after printing. The leading end of the backing sheet 6 from which the labels 7 have been detached may be taken up by a take-up spindle (illustrated in FIG. 1).

Since print head 2 heats the carbon ribbon 5 to create image patterns on the labels 7, the carbon ribbon 5 must be very thin, preferably no more than several hundredths of a millimeter. As long as the label strip 4 and the carbon ribbon 5 are relatively narrow it is easy to guide the carbon ribbon 5 without wrinkling. But that is not the case for a relatively wide carbon ribbon. Guiding and transporting a relatively wide carbon ribbon is prone to create variations in the tensile force across the width of the ribbon. These tensile force variations tend to wrinkle the ribbon. To prevent the problem, it is necessary to feed and orient the carbon ribbon 5 in a very precise manner relative to the thermal print head 2 and the platen 3. This requires the spindle from which the ribbon 5 is supplied and its guiding rollers to be precisely maintained at a parallel orientation to the printing plane of the print head and the platen.

Specifically, the angle of the supply spindle of the carbon ribbon relative to the frame of the printer must be set precisely to 90°. Otherwise, variations in tensile force are certain to develop across the width of the carbon ribbon 5 with consequent wrinkling and weaving of the ribbon, as denoted, for example, by reference character W in FIG. 5. Wrinkling of the ribbon 5 adversely impacts the print quality at the location of the overlapping and wrinkling W on the ribbon 5.

The wrinkling problem can be tolerated to an extent when human readable characters are imprinted on the labels 7. However, where machine-readable characters, such as bar-codes and the like, are printed, wrinkling has a disastrous effect since the width and spacing between bars in a barcode is critical to the readability of the printed information.

The wrinkling problem does not arise if the axes of the supply spindle of carbon ribbon 5 of the platen 3 and of the take-up spindle of the carbon ribbon (all of which are mounted perpendicularly to the frame of the printer) are precisely aligned parallel to one another. But in reality it is impractical, if not impossible, to design and fabricate label printers whose internal mechanisms are or remain perfectly aligned to one another to prevent the ribbon wrinkling problem.

SUMMARY OF THE INVENTION

It is therefore an object of the present invention to provide a mechanism for preventing wrinkling of thin, comparatively wide, carbon ribbons.

It is a further object of the invention to provide a mechanism for preventing wrinkling of carbon ribbons which mechanism is adjustable to overcome manufacturing and assembly tolerances.

It is a further object of the invention to provide a carbon ribbon wrinkling preventing mechanism having a carbon ribbon supply spindle whose angle of inclination relative to its support frame is adjustable.

The above and other objects of the invention are realized by means of a carbon ribbon supply system having a spindle which is supported, cantileverly, at one end thereof. The supported end of the carbon ribbon supply spindle is rotatably supported in first and second, axially spaced, bearings, the bearings being respectively disposed in adjacent, closely spaced, first and second frame parts. The axis of the second bearing is slightly off-center relative to the axis of the first bearing, and the second bearing is supported on a round rotatable adjustment plate attached to the second frame part. The arrangement allows precise positioning of the second bearing relative to the second frame part, through rotation of the adjusting plate. This in turn enables the axis of the ribbon supply spindle to be finely adjusted so as to be perfectly parallel to axes of the guiding spindles, the platen and the ribbon take-up spindle.

In a preferred embodiment, rotation of the round adjustment plate causes the supported distal end region of the carbon ribbon supply spindle to move along a conical path relative to the first bearing. This enables the spindle to be inclined at a desired angle relative to the frame of the printer to attain the desired parallelism with the other components.

Other features and advantages of the present invention will become apparent from the following description of the invention which refers to the accompanying drawings.

DETAILED DESCRIPTION OF A PREFERRED EMBODIMENT

Figure 1:
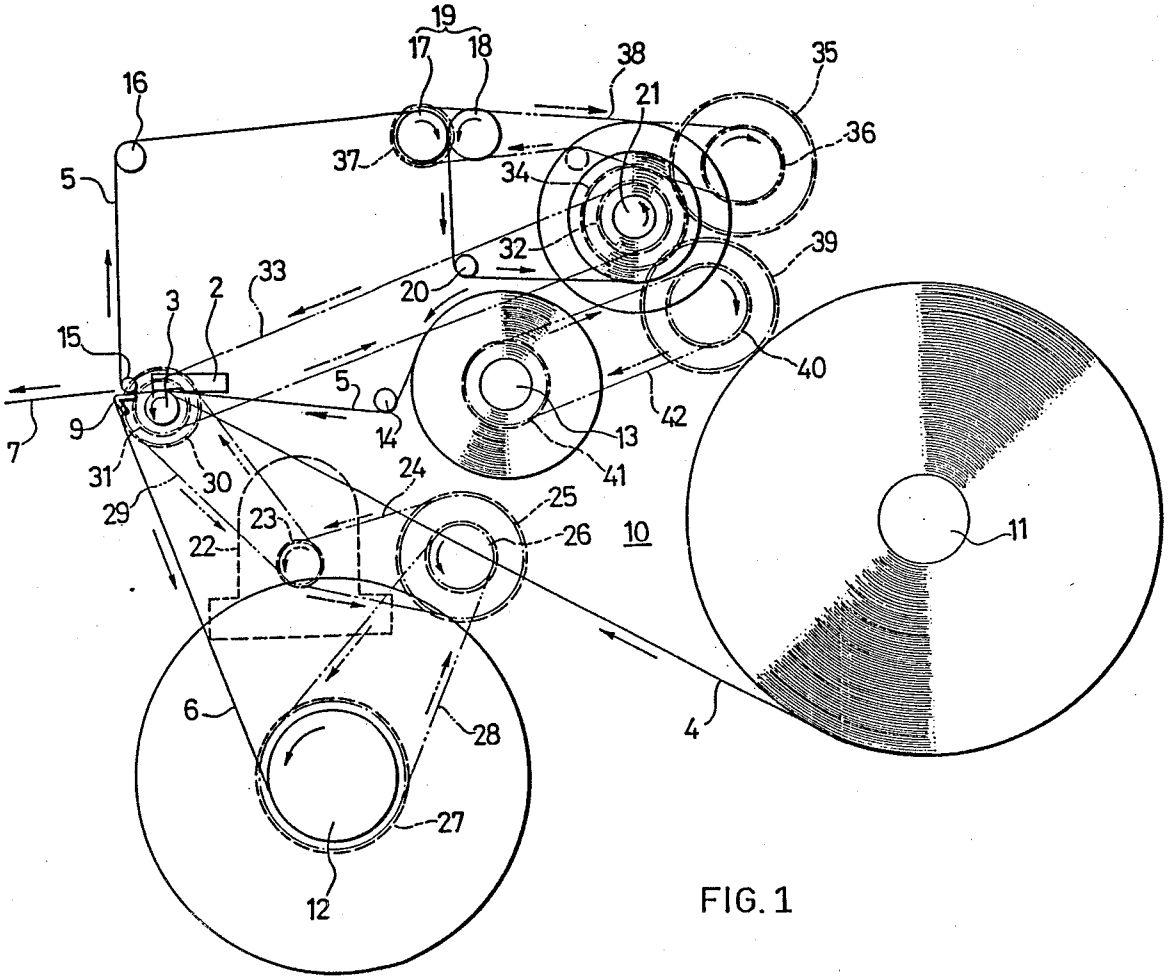
FIG. 1 is a general plan view of a printing apparatus in accordance with an embodiment of the present invention.

The invention is described below by reference to FIGS. 1–5 in which identical parts are denoted by like reference numerals for efficiency in description.

As depicted in the general plan view of FIG. 1, the label strip 4 is paid out from a label strip pay out spindle 11 which is supported on a first frame 10, the strip 4 being fed between a thermal print head 2 and a platen 3. The printing face of print head 2 faces platen 3. If desired, the backing sheet 6 portion of the strip 4 may be redirected by sharp bending thereof at label peeling plate 9 to cause labels 7 to peel off the backing sheet 6. The backing sheet 6 is taken up on a backing sheet take-up spindle 12. Alternatively, thermal label strip 4 including the backing sheet 6 may be fed out the front of label peeling plate 9 without redirection of the backing sheet 6 at label peeling plate 9.

Carbon ribbon 5 is paid out from a carbon ribbon supply spindle 13 and is guided by a guide roller 14 to travel between thermal print head 2 and platen 3, in superposition with thermal label strip 4. Other guide rollers 15 and 16 and a feed mechanism 19 comprised of a drive roller 17 and a follower roller 18 guide carbon ribbon 5 further to a final guide roller 20 which guides the carbon ribbon 5 to its take-up spindle 21.

The spindle and guide roller of label strip 4 are driven by a stepping motor 22 having an output shaft 23 whose rotation is transmitted, via a timing belt 24, an intermediate gear 25, an intermediate pulley 26 and a belt 28, to the backing sheet take-up spindle 12. The arcuate arrow drawn next to take-up spindle 12 indicates its rotational direction.

A platen gear 30 rotates integrally with platen 3 and is driven by a timing belt 29 which is coupled to the output shaft 23 of stepping motor 22. Another belt 33 extends from a platen pulley 31 to a carbon ribbon take-up pulley 32, the pulleys 31 and 32 being respectively rotatingly coupled to platen gear 30 and to carbon ribbon take-up spindle 21.

A further gear 34 rotates with take-up pulley 32 and serves to rotate a carbon ribbon feeding mechanism 19, via an intermediate gear 35, another intermediate gear 36, a timing belt 38 and a drive roller 37. The above elements cooperate to feed the carbon ribbon 5 toward its take-up spindle 21.

The gear 34 also engages a back-tension gear 39. Gear 39 is in turn coupled to the pulley 41 on carbon ribbon supply spindle 13, via a back-tension pulley 40 and a belt 42. Note that pulley 41 is coupled to spindle 13 through a slip mechanism (to be described) and that it rotates clockwise, that is oppositely to spindle 13, to thus exert a back-tension on the carbon ribbon 5. This keeps the carbon ribbon 5 taut and to an extent wrinkle-free.

Figure 2:
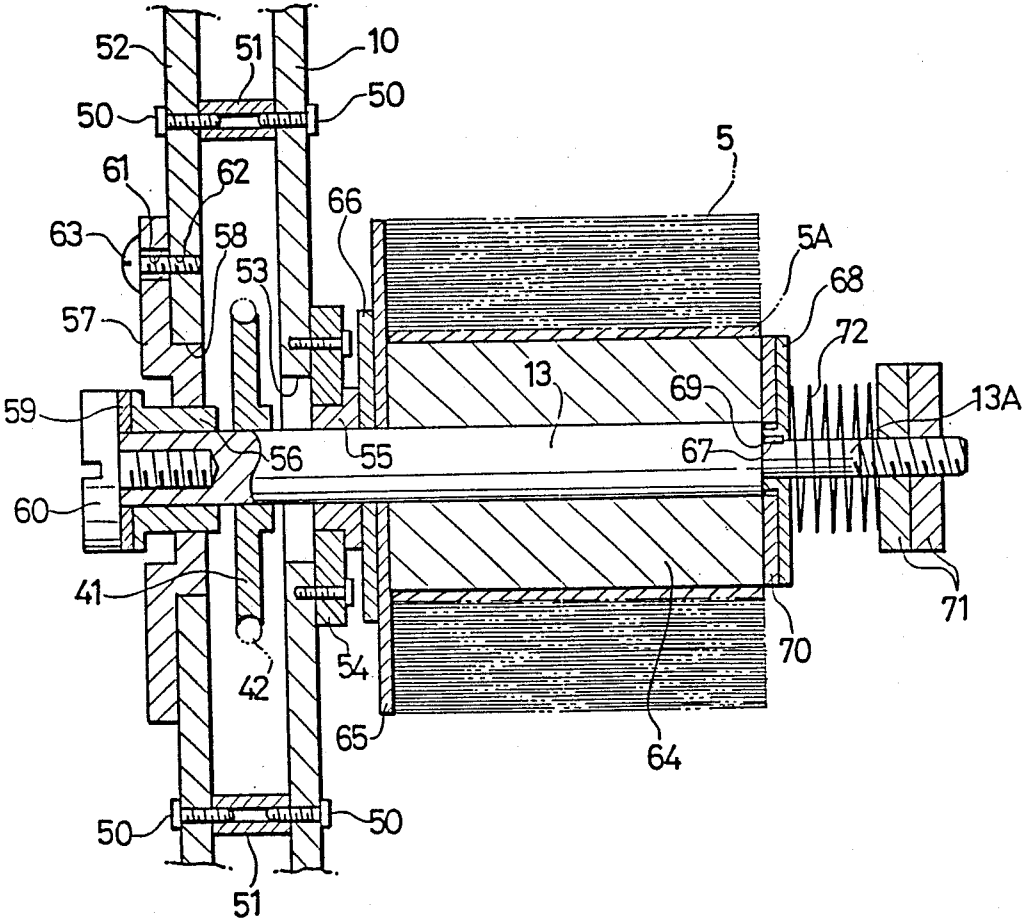
FIG. 2 is a longitudinal section through the supply spindle for the carbon ribbon.

Turning to FIG. 2, the carbon ribbon supply spindle 13 is supported cantileverly at one end thereof, whereby it extends horizontally from the flat, vertical, plate-shaped, first frame 10. Other elements including the label strip pay-out spindle 11, the backing sheet take-up spindle 13, the carbon ribbon take-up spindle 21, the thermal print head 2, the platen 3, the carbon ribbon feeding mechanism 19 and the guide rollers 14, 15, 16 and 20 are also supported on and extended perpendicularly to first frame 10.

A second frame 52 extends parallel to and spacedly from first frame 10, the frames 10 and 52 being interconnected by bolts 50 and spaced by collars 51. The supported end of carbon ribbon supply spindle 13 extends to and is further supported at the second frame 52. The spindle 13 traverses the space between the frames 10 and 52 and the collars 51. This space is partially occupied by the aforementioned back tension producing pulley 41 which is fixed to carbon ribbon supply spindle 13.

More specifically, the carbon ribbon supply spindle 13 is rotatably supported at first frame 10 by a first bearing 55, the bearing 55 being located in a through-hole 53 and secured to first frame 10 by a bearing retainer plate 54 and several bolts. At the second frame 52, spindle 13 is supported in a second bearing 56 which bearing 56 is mounted to a round adjusting plate 57 by means of a washer 59 and a fixing bolt 60. The adjusting plate 57 is in turn rotatably supported in the through-hole 58 of second frame 52. Both bearings 55 and 56 may be constituted of ball bearings or the like or of any other type of bearing.

Figure 3:
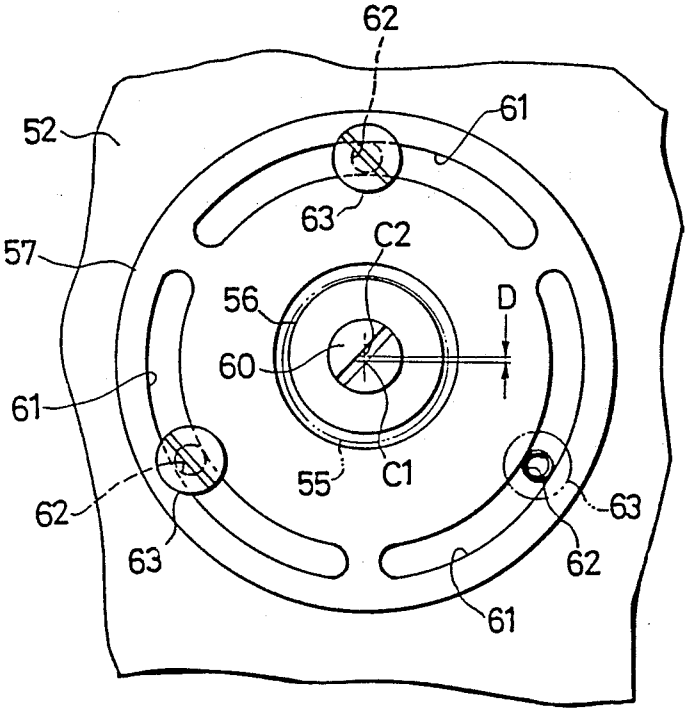
FIG. 3 is a plan view of the round adjusting plate of the carbon ribbon supply mechanism.
Figure 5:
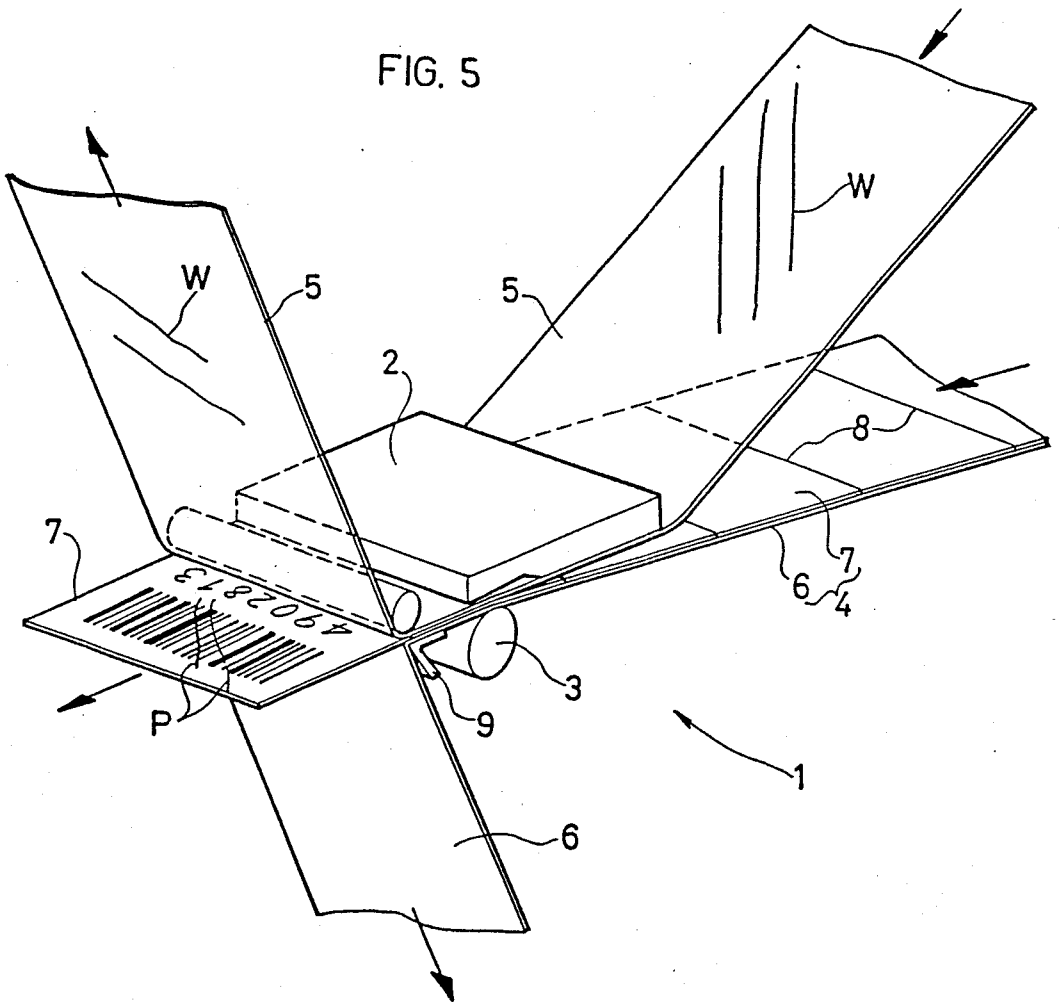
FIG. 5 depicts a conventional thermal label strip and print head and platen components of a label printer.

As seen in FIG. 3, adjusting plate 57 contains several arc-shaped and equally spaced slots 61. Adjustment bolts 63 pass through the slots 61 and screw into clamp-screw holes 62 on second frame 52 in a manner which enables adjusting the angular orientation of the plate 57 relative to the frame 52.

Figure 4:
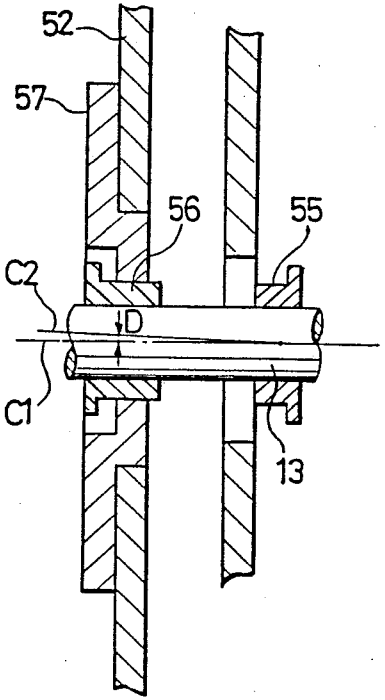
FIG. 4 is a longitudinal section showing the relative locations of the first and second bearings of the carbon ribbon supply spindle.

FIG. 4 shows the relative positions of the bearings 55 and 56. The center line C2 of the second bearing 56 is offset relative to the center line C1 of the first bearing 55 by a deviation D, measuring several tenths of a millimeter. It is possible, by rotating the adjusting plate 57, to set the second bearing 56 to an exact position at which the axid of the carbon ribbon spindle 13 is precisely aligned to a desired orientation relative to the first frame 10. More specifically, the center line of the spindle 13 describes a cone-shaped path having an apex at the first bearing 55, when the second bearing is rotated clockwise and counterclockwise. As a result, if wrinkling appears on the carbon ribbon 5 during preliminary testing (usually following assembly of the printing unit), the adjustment bolts 63 may be loosened slightly (without removing) to allow the adjusting plate 57 to be rotated clockwise or counterclockwise until a position is found where the wrinkling disappears. The bolts 63 are then retightened to lock the position of the second bearing 56.

Referring back to FIG. 2, a carbon ribbon bobbin 64 is disposed on the supply spindle 13, to the right of bearings 55 and 56 and sufficiently loosely to enable the bobbin 64 to slide on the spindle 13. A roll of carbon ribbon 5 having a core 5A is mounted on and rotatable with the bobbin 64. An annular steel flange 65 is attached to the bobbin 64 and a cork pad 66, which functions as a slide bearing, separates the flange 65 from the first bearing 55.

The free end of the spindle 13, which protrudes to the right of bobbin 64, is reduced in diameter to form a portion 13A with a projecting key 67 which engages a key way 69 on a facing stainless steel round plate 68. The round plate 68 rotates with the spindle 13. A second cork pad 70 forms another slide bearing which is disposed between the round plate 68 and the bobbin 64.

The distal end of the reduced-diameter portion 13A is threaded to receive a nut 71 suitable for compressing, to a desired degree, a thrust spring 72. The spring 72 urges the bobbin 64 toward the first frame 10 and presses the plate 68 and the bobbin 64 against the cork pad 70. The spring 72 and nut 71 therefore set the degree of frictional interengagement betwen the spindle 13 and the bobbin 64.

In the above arrangement, the bobbin 64, the annular steel flange 65 attached to the bobbin 64, and the carbon ribbon 5 rotate counterclockwise (as seen in FIG. 1), in response to pulling of the ribbon 5 by the ribbon feeding mechanism 19. It should be noted that since the mechanism 19 is driven by the stepping motor 22, carbon ribbon 5 is pulled intermittently in jerky motions, which is more prone to slacken the ribbon 5.

To remedy the problem, the pulley 41, the spindle 13 and the stainless steel round plate 68 rotate clockwise, oppositely to the bobbin 64. The counter rotating motion of the plate 68 is applied to the bobbin 64 through the cork pad 70. Similarly, the flange 65 of the bobbin 64 rotates relative to the stationary first bearing 55 through the cork pad 66.

The cork pads 66 and 70 thereby allow the plate 68 and the bobbin 64 to "slip" relative to one another and allows the spindle 13 to apply a counter rotating force to the bobbin in a direction opposite to the carbon ribbon feeding direction. The magnitude of this counter rotation force depends on the degree of friction between the plate 68 and the bobbin 64 (through the cork pad 70) and is set by the degree to which the nut 71 and the spring 72 are tightened. (The degree of frictional tension between the flange 65 and the stationary first bearing 55 is similarly set by the nut 71.). In any case, the degree of tension is set to allow the carbon ribbon feeding mechanism 19 to overcome the counter force applied from the spindle 13, while allowing the spindle 13 to rotate the bobbin 64 oppositely to the carbon ribbon feeding direction to absorb any slack in the carbon ribbon 5. The result is that the carbon ribbon 5 remains taut and slack free, despite being driven by a stepping motor.

The spindle adjusting mechanism of the present invention thus provides a means for compensating for manufacturing or assembly tolerances and allows the ribbon supply spindle 13 to be oriented such that it is aligned perfectly parallel to the rest of the carbon ribbon guidance mechanism. Consequently, the width-wide extending tensile forces on the ribbon 5 are uniformly distributing to reliably and effectively prevent wrinkling.

The degree of inclination of the second bearing 56 relative to the first bearing 55 typically depends on the width and thickness of the carbon ribbon 5 and on the characteristics of the other elements which comprise the supply and guiding mechanism for the ribbon 5.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A printer, comprising:

a frame;

a print head and a platen for urging a carbon ribbon against the print head;

means for supplying a carbon ribbon and for guiding the carbon ribbon against the print head, the carbon ribbon supplying means including a carbon ribbon supply spindle defined about an axis and mounted to and extending generally perpendicularly to the frame;

means for supporting the spindle cantileverly on the frame, the frame including a first frame part and a second frame part generally parallel to and spaced from the first frame part, the spindle being supported at a first predetermined location in the first frame part and at an adjustable location on the second frame part; and means for adjusting the orientation of the axis of the carbon ribbon supply spindle relative to the frame in a manner which is effective for preventing wrinkling of the carbon ribbon, the spindle adjusting means being located on the second frame part and including a rotatable adjusting plate disposed on and extending generally parallel to the second frame part and a spindle bearing mounted to the adjustment plate, a distal end of the spindle being received in the spindle bearing and the spindle bearing being so located on the adjusting plate that the rotation of the adjusting plate is effective to vary the orientation of the axis of the spindle relative to the first frame part.

2. The printer of claim 1, wherein the spindle bearing is so disposed on the adjusting plate that rotation of the adjusting plate causes the position of the spindle between the frame parts to describe a cone having a base at the second frame part.

3. The printer of claim 1, further including another bearing mounted to the first frame part and the spindle being rotatably supported in the bearing of the first frame part.

4. The printer of claim 3, wherein the bearing at the second frame part is disposed off-center relative to the bearing disposed at the first frame part.

5. The printer of claim 1, further including a bobbin mounted on the spindle for supporting a roll of carbon ribbon, the bobbin being rotatable in a first direction to supply ribbon to the print head and including tensioning means for counter-rotating the spindle for tensioning the ribbon.

6. The printer of claim 5, wherein the tensioning means comprises a pulley on the spindle and means for driving the pulley in a direction opposite to the first direction, and a slip mechanism for coupling the bobbin and the spindle.

7. The printer of claim 6, further comprising a plate on the spindle and a slide bearing between the bobbin and the plate for obtaining sliding tension between the bobbin and the plate and means for adjusting the magnitude of the sliding tension between the plate and the bobbin.

8. The printer of claim 7, wherein the sliding tension adjusting means includes an extension protruding axially from the free end of the spindle, a spring on the extension and a bolt for compressing the spring to urge the plate toward the bobbin.

9. The printer of claim 8, wherein the extension at the free end of the spindle has a diameter which is smaller than the diameter of the spindle at a portion thereof which is coupled to the bobbin.

10. A carbon ribbon supplying device for a printer, comprising:

a carbon ribbon supply spindle for supporting a roll of carbon ribbon;

a first frame and a first bearing mounted at the first frame at a fixed location thereon, the first bearing rotatably supporting the spindle at a first end of the spindle;

a second frame adjacent and spaced from the first frame and a second bearing secured at the second frame at an adjustable location thereon, the second bearing having an axis which is off-center relative to an axis of the first bearing, the first end of the spindle being further supported in the second bearing;

a movable adjusting plate, the second bearing being supported on the adjusting plate and the adjusting plate being mounted on and extending generally parallel to the second frame; and securing means for securing the adjusting plate against movement relative to the second frame, whereby the adjusting plate is movable to vary the location of the second bearing relative to the second frame to thereby enable orienting of the axis of the spindle relative to the first frame, the spindle being supported cantileverly and only at the first and second frames.

11. The carbon ribbon supply apparatus of claim 10, wherein the adjusting plate is round and rotatable in an opening in the second frame.

12. The carbon ribbon supply apparatus of claim 11, further comprising at least one arc-shaped slot in the adjusting plate and a plurality of clamping means for clamping the position of the adjusting plate relative to the second frame at desired locations.

* * * * *